US007874438B2

(12) United States Patent
Després

(10) Patent No.: US 7,874,438 B2
(45) Date of Patent: Jan. 25, 2011

(54) BOOM ASSEMBLY

(76) Inventor: Jean Després, 550, rang 1, St-Antonin, Québec (CA) G0L 2J0

( * ) Notice: Subject to any disclaimer, the term of this patent is extended or adjusted under 35 U.S.C. 154(b) by 46 days.

(21) Appl. No.: 12/193,217

(22) Filed: Aug. 18, 2008

(65) Prior Publication Data

US 2009/0074552 A1 Mar. 19, 2009

Related U.S. Application Data

(60) Provisional application No. 60/956,135, filed on Aug. 16, 2007.

(51) Int. Cl.
*B66C 23/84* (2006.01)

(52) U.S. Cl. ..... 212/292; 212/223; 212/253

(58) Field of Classification Search ..... 212/223, 212/253, 292

See application file for complete search history.

(56) References Cited

U.S. PATENT DOCUMENTS 2,782,940 A * 2/1957 Beseler ..... 414/543
4,200,315 A * 4/1980 Carlsson ..... 280/492
4,496,166 A * 1/1985 Anderson ..... 280/401
6,893,189 B2 * 5/2005 Matsushita et al. ..... 405/155

FOREIGN PATENT DOCUMENTS

SU 1214510 A * 2/1986

* cited by examiner

*Primary Examiner*—Thomas J. Brahan
(74) *Attorney, Agent, or Firm*—Ogilvy Renault LLP

(57) ABSTRACT

A boom assembly comprising: a base anchored to a structure/ground. A boom is rotatably mounted to the base at a connected end so as to be rotatable about a generally vertical axis, the boom having a device to support loads at a free end. An orientation clutch is provided between the base and the boom. The orientation clutch has a mechanism for locking a rotation of the boom with respect to the generally vertical axis so as to selectively adjust an orientation of the boom. The orientation clutch has a release configuration to allow the boom to self-adjust its orientation to align with a load pulled by the device.

15 Claims, 8 Drawing Sheets

BOOM ASSEMBLY

CROSS-REFERENCE TO RELATED APPLICATION

This patent application claims priority on U.S. Provisional Patent Application No. 60/956,135, filed on Aug. 16, 2007.

FIELD OF THE APPLICATION

The present application relates to a boom assembly primarily for domestic use, but also used in industrial applications.

BACKGROUND OF THE ART

Boom assemblies (e.g., cranes) are commonly present in domestic uses to displace loads onto vehicles. For instance, boom assemblies are used to displace lumber onto a trailer.

One of the issues with boom assemblies for domestic use is that they require numerous maneuvers during operation. The operator must constantly move between the load and the boom assembly, for example to ensure that the boom of the boom assembly is aligned with the load, or to displace a lifted load onto a vehicle.

Accordingly, various boom assemblies have been developed with different mechanisms to simplify their operation. However, such improvements have often been to the detriment of safety, as a lifted load on a freely rotating boom if a safety hazard.

SUMMARY OF THE APPLICATION

It is therefore an aim of the present disclosure to provide a boom assembly that addresses issues associated with the prior art.

Therefore, in accordance with the present application, there is provided a boom assembly comprising: a base anchored to a structure/ground; a boom rotatably mounted to the base at a connected end so as to be rotatable about a generally vertical axis, the boom having a device to support loads at a free end; and an orientation clutch between the base and the boom, the orientation clutch having a mechanism for locking a rotation of the boom with respect to the generally vertical axis so as to selectively adjust an orientation of the boom, the orientation clutch having a release configuration to allow the boom to self-adjust its orientation to align with a load pulled by the device.

DESCRIPTION OF THE PREFERRED EMBODIMENTS

Figure 1:
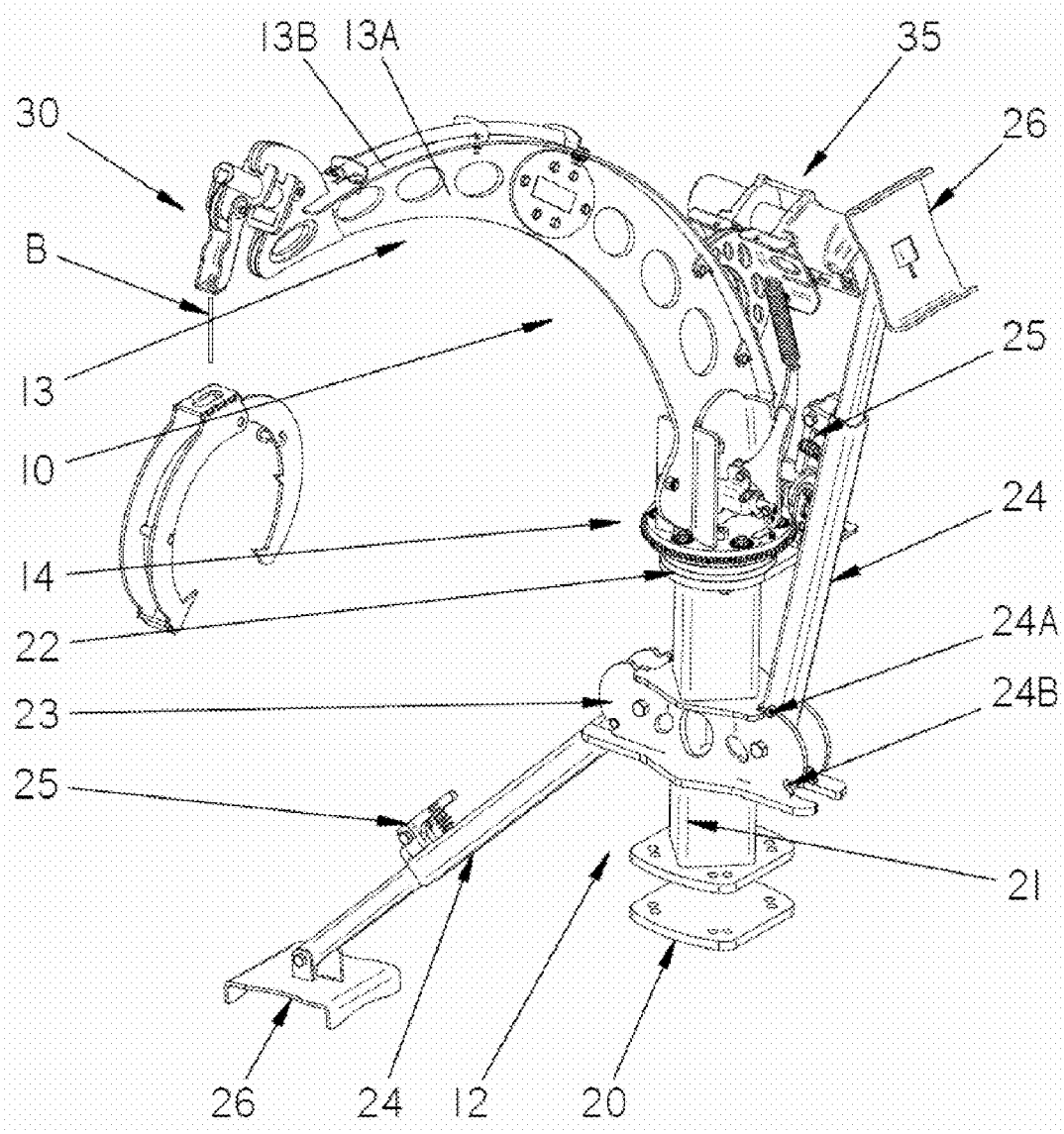
FIG. 1 is a front perspective view of a boom assembly in accordance with an embodiment of the present disclosure.
Figure 2:
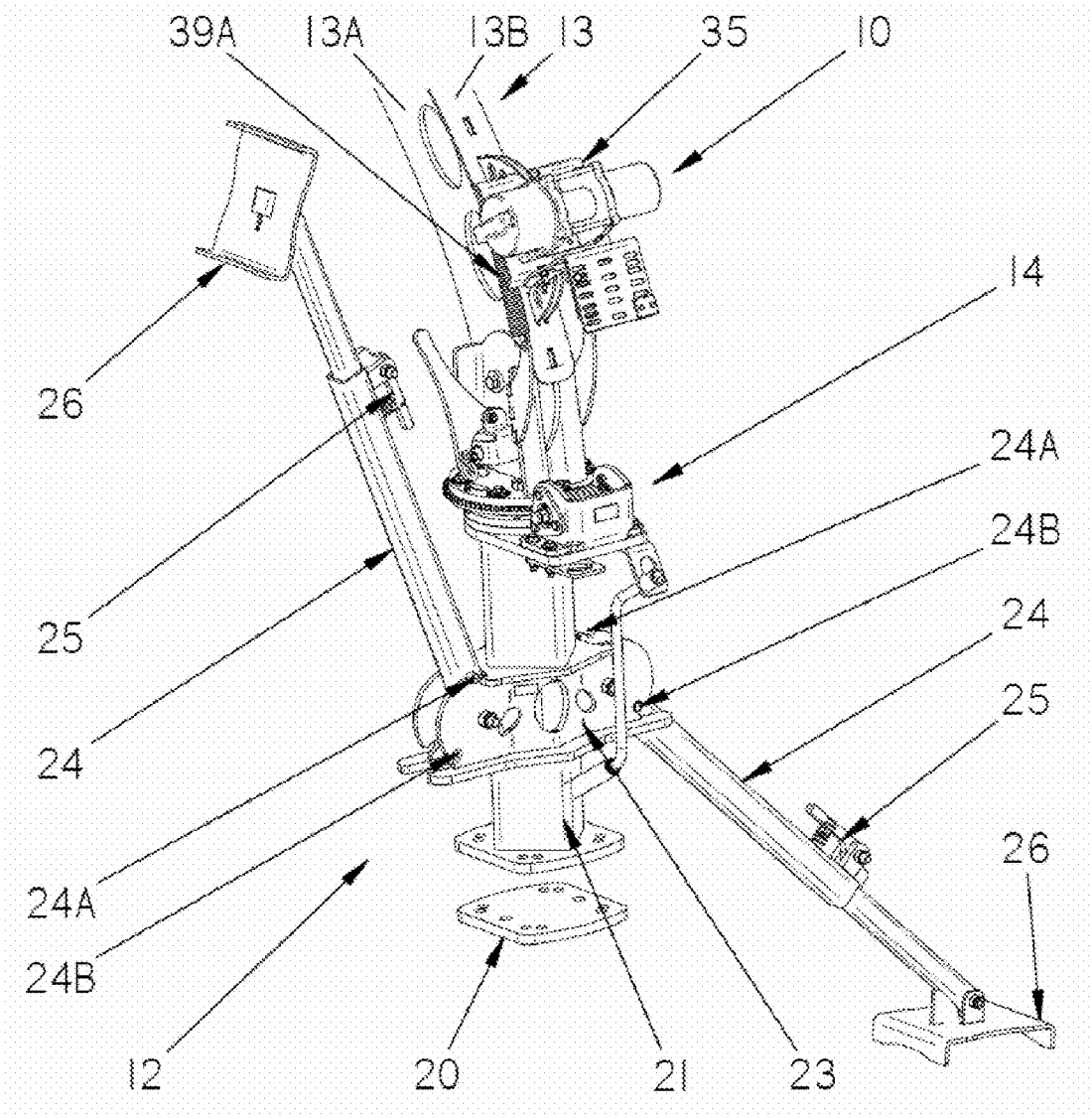
FIG. 2 is a rear perspective view of the boom assembly of FIG. 1.

Referring to the drawings, and more particularly to FIGS. 1 and 2, a boom assembly in accordance with a preferred embodiment is shown at 10. The boom assembly 10 has a base 12, a boom 13 and an orientation clutch 14.

The base 12 is the interface between the boom assembly 10 and a vehicle, such as a trailer, or a support structure in the event that the boom assembly is fixed.

The boom 13 is the load-bearing arm of the boom assembly 10.

The orientation clutch 14 interconnects the boom 13 to the base 12, and allows the adjustment of the orientation of the boom 13 with respect to the base 12 from manual actuation, as well as an overload slide of the boom 13 in the base 12. The rotation of the boom 13 by way of the clutch is with regard to a generally vertical axis (i.e., generally upright, not necessarily normal to the ground, considering that the boom assembly 10 is used on a trailer on rough terrain).

Figure 7:
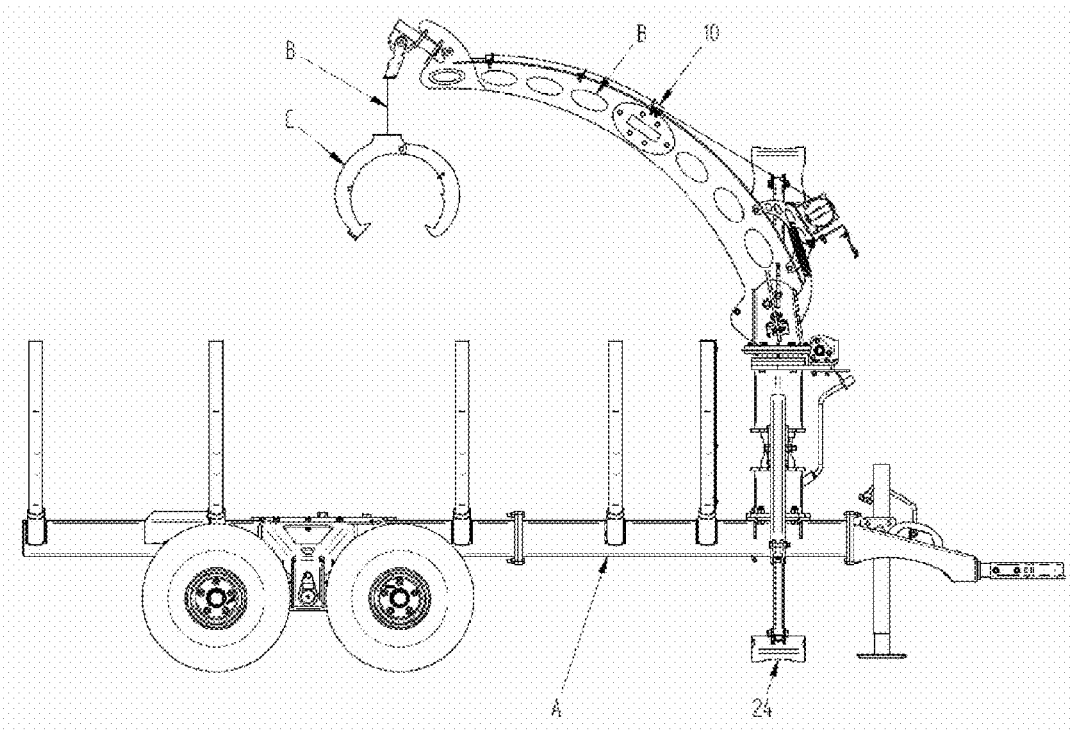
FIG. 7 is a perspective view of the boom assembly as positioned on a trailer.

Referring to FIGS. 1 and 2, the base 12 has a beam connector 20, by which the base 12 is releasably connected to a beam of a vehicle. As is shown in FIG. 7, the base 12 is secured to a trailer A by way of the beam connector 20. Various alternatives are considered in addition to the beam connector 20.

A column 21 extends upwardly from the beam connector 20. A flange 22 is provided at a top end of the column 21 to support the orientation clutch 14, as will be described hereinafter.

A carriage 23 is slidably mounted to the column 21 and is displaceable vertically. The carriage 23 is locked in a selected vertical position on the column 21. Alternatively, the carriage 23 may simply be a structure fixed on the column 21.

Support arms 24 are pivotally mounted to the carriage 23 and project laterally therefrom. The support arms 24 are telescopic, and may therefore be extended/shortened in length, using biased locking fingers 25. The support arms 24 are displaceable between a support position, as illustrated on the right-hand side support arm 24 in FIG. 2, or in a retracted position, as illustrated in the left-hand side support arm 24 in FIG. 2. The positions are set by the cooperation of pins 24A on the arms 24 and slots 24B in the carriage 23. The arms 24 are axially biased toward the carriage 23 to ensure they remain in position. Therefore, in order to change the position of the arms 24, the arms 24 are pulled axially away from the carriage 23 until the pins 24A are out of the slots 24B. The arms 24 may then be rotated to the other position, and will click into position by the biasing member within each of the arms 24. The biasing member is selected so as to allow an operator to manually pull the arms 24 out of the retracted or support positions.

Platforms 26 are provided at the free ends of the arms 24, and are the interface of the support arms 24 with the ground. Accordingly, as is shown in FIG. 7, the boom assembly 10 is partly supported by the arms 24 contacting the ground. It is observed that the plates of the carriage 23 pivotally supporting the arms 24 have a non-negligible surface so as to define an abutment surface for the upper ends of the arms 24.

Referring to FIG. 1, the boom 13 is shown having an arcuate body (i.e., an arcuate beam member), at the end of which a pulley mechanism 30 is positioned. The arcuate body of the boom 13 is made of a beam member having a T-shaped section (with a central section 13A and a lateral web 13B projecting laterally from a top of the central section 13A), although other sections are also considered. Accordingly, the boom 13 is structurally conceived to support loads in the plane in which the central section 13A lies.

The arcuate shape of the boom 13 allows the supporting end of the boom 13 (FIG. 6), to be off-centered with a rotation axis of the orientation clutch 14, from a top plan view. Accordingly, the boom 13 may be rotated about the rotation axis of the clutch 14 while supporting a load, without the load contacting the boom 13.

Figure 6:
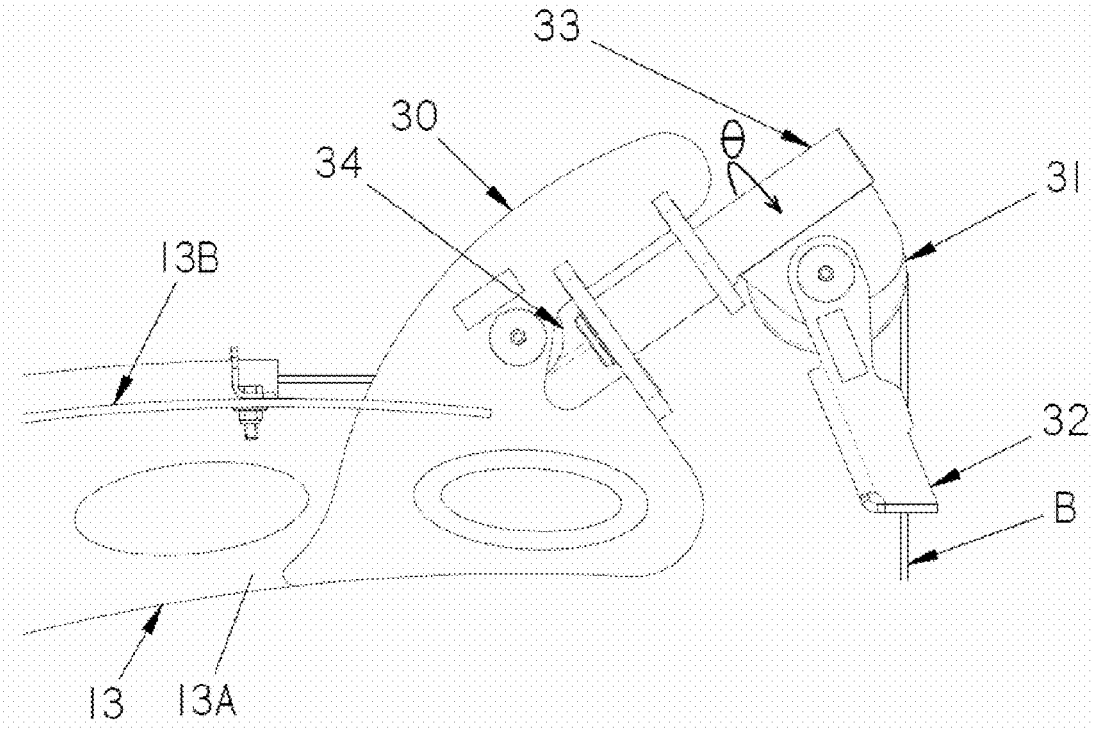
FIG. 6 is an enlarged side view of a pulley assembly of the boom assembly of FIG. 1.

Referring to FIGS. 1 and 6, the pulley mechanism 30 at the end of the boom 13 is shown in greater detail. The pulley mechanism 30 has an output pulley 31 as well as a cable aligner 32. A barrel 33 and the cable aligner 32 ensure that the cable B remains in position on the output pulley 31. Moreover, the barrel 33 is freely rotatable along its longitudinal axis, as illustrated by θ, with the output pulley 31 and the cable aligner 32 rotating with the barrel 33. Therefore, the barrel 31 orients automatically as a function of a pulling direction on the load.

An idler pulley 34 is provided between the end of the lateral web 13B of the boom 13 and the barrel 33, and guides the cable B along the web 13B to a winch or like actuator (not shown). The actuator of the cable is typically supported on the boom 13 by way of support 35.

Although other types of tools/interfaces may be positioned at the end of the boom 13, the pulley mechanism 30 is particularly well suited to support loads with the boom 13. As is shown in FIG. 7, a pair of jaws C are provided at the free end of the cable B to support loads such as lumber.

Figure 3:
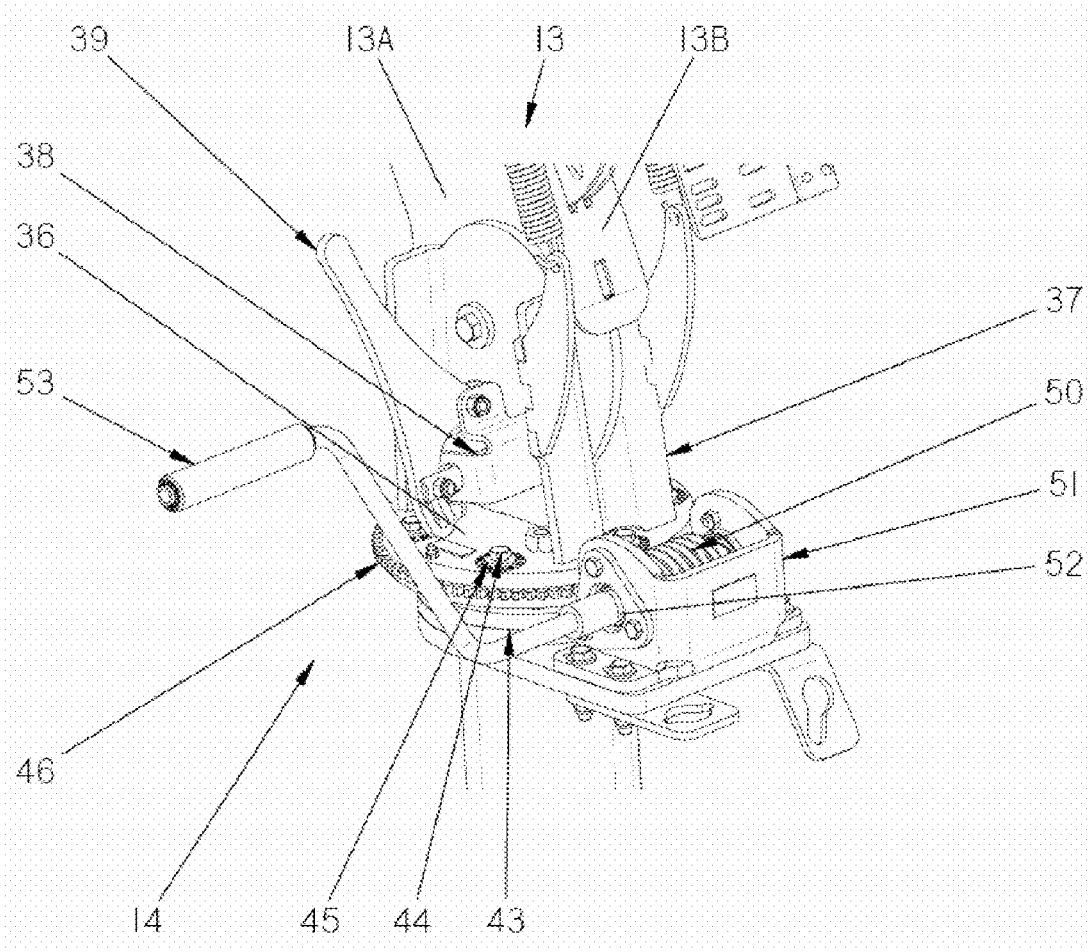
FIG. 3 is an enlarged perspective view of an orientation clutch of the boom assembly of FIG. 1, with a crank.
Figure 5:
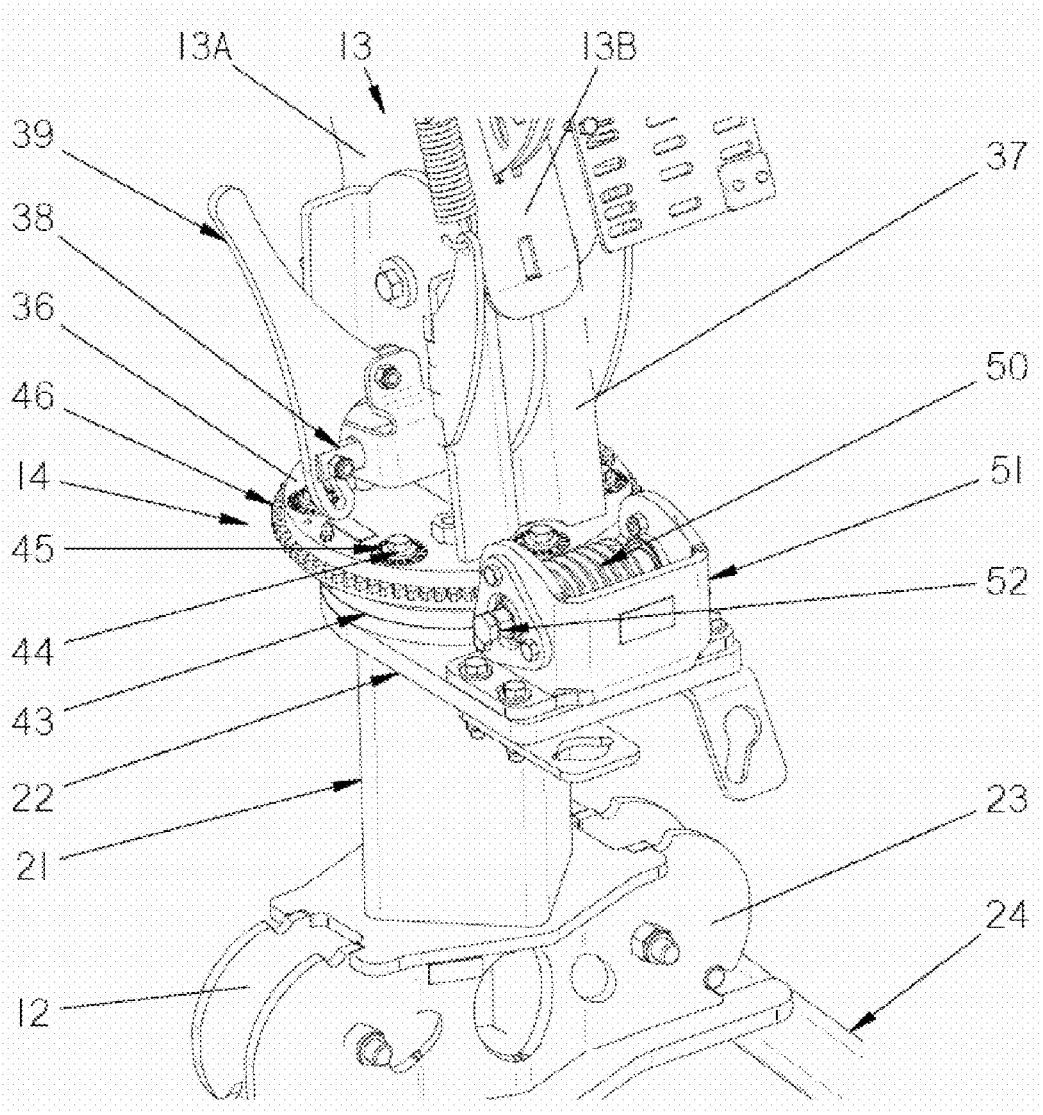
FIG. 5 is an enlarged perspective view of the orientation clutch of FIG. 3, without a crank.

Referring to FIGS. 3 and 5, the boom 13 is connected at its bottom end to a boom flange 36, by way of a support bracket 37. The support bracket 37 pivotally supports the boom 13, such that the boom 13 is pivotable with respect to the boom flange 36, to have different inclinations. A locking finger 38 is provided to lock the boom 13 at different inclinations. The locking finger 38 is manually actuated by way of a lever 39. It is typically preferred that the boom 13 be inclined to a horizontal-most position when pulling a load, and to a vertical-most position when lifting a load. However, for safe use of the boom assembly 10, the boom 13 should not be rotated from the horizontal-most position to the vertical-most position when supporting a load.

In order to facilitate the setting of the boom 13 to the vertical-most position of FIG. 1, it is considered to provide springs between the boom 13 and the clutch 14, as illustrated at 39A. The springs 39A help an operator in manually lifting the boom 12 to the vertical-most position.

Figure 4:
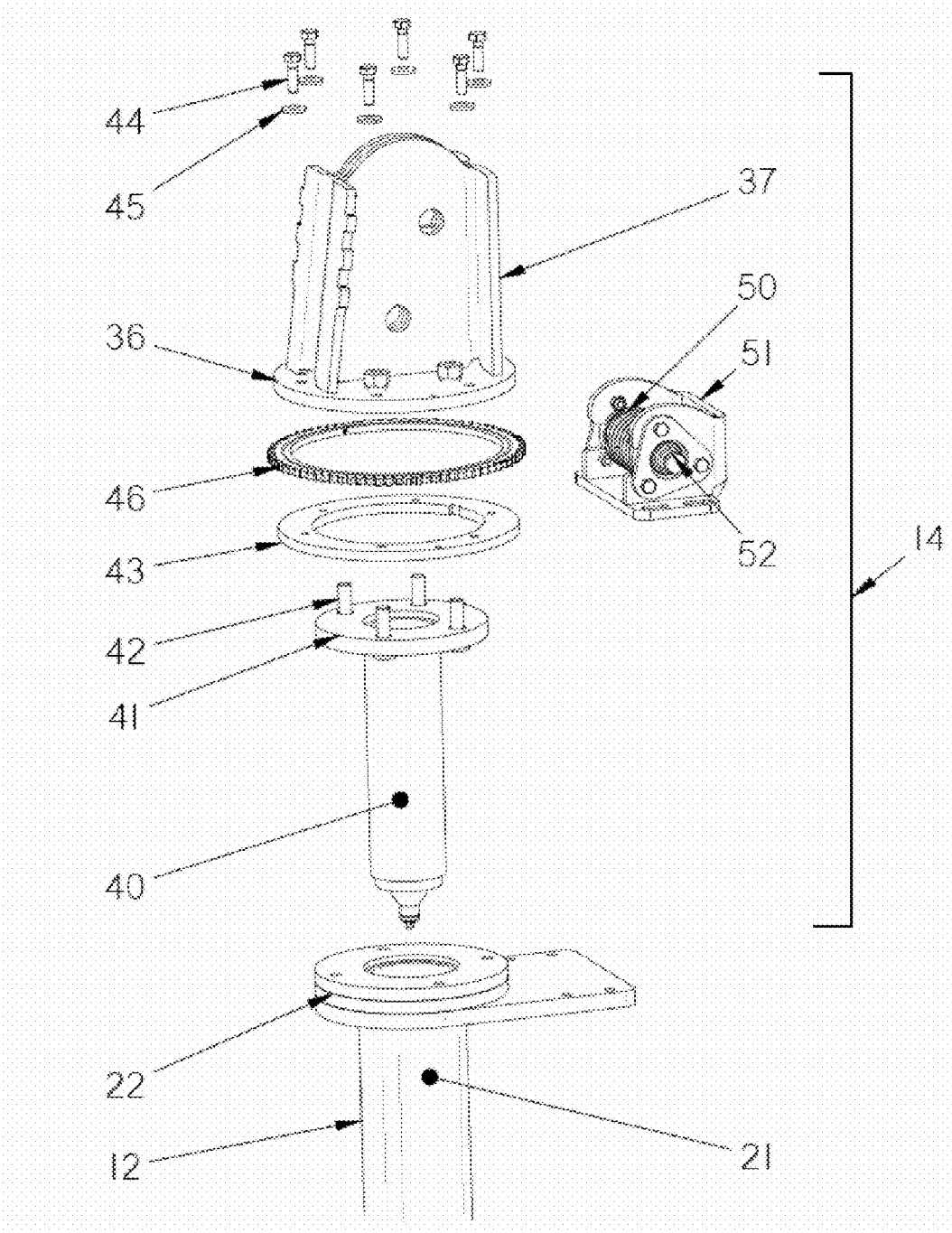
FIG. 4 is an exploded view of the orientation clutch of FIG. 3.

Referring to FIGS. 3-5, the orientation clutch 14 is shown in greater detail. The clutch 14 has an axle 40 that is accommodated in the column 21 of the base 12, so as to rotate therein along a vertical axis. An axle flange 41 is provided at a top end of the axle 40. By way of fasteners 42, the axle flange 41 is secured to the boom flange 36 so as to rotate therewith. Accordingly, by the interconnection of the boom flange 36 with the axle flange 41, the boom 13 rotates on the base 12 as supported by the axle 40. According to one embodiment, a locking ring (not shown) is used at the bottom of the axle 40 to releasably lock the axle 40 to the base 12.

A friction ring 43 is connected to the boom flange 36 by a plurality of fasteners 44. In the illustrated embodiment, the fasteners 44 are bolts, received in tapped holes in the friction ring 43. Belleville washers 45 are provided between the heads of the bolts 44 and the boom flange 36, and bias the bolts 44 upwardly. Accordingly, the friction ring 43 is pulled upwardly by the action of the Belleville washers 45 between the bolts 44 and the boom flange 36. Therefore, pinion 46, sandwiched between the boom flange 36 and the friction ring 43, is held by friction therebetween.

The pinion 46 is in operative engagement with the endless screw 50. The endless screw 50 is supported by bracket 51, and is actuated via a connector 52. The connector 52 connects to a crank 53, as is illustrated in FIG. 3. Therefore, rotation of the crank 53 causes a rotation of the endless screw 50. The endless screw 50 cooperates with the pinion 46 to transmit the rotational actuation of the crank 53 to a rotation of the boom 13 on the base 12. Because of the interaction between the pinion 46 and the endless screw 50, the boom 13 is locked in position when lifting a load. Therefore, when lifting a load, the boom 13 is selectively rotated by actuation of the crank 53 (FIG. 3). Various mechanisms are considered as alternatives to the endless screw 50, such as spur gears, chain drives, pulley and belt drives, etc.

As explained above, the boom 13 is designed to support maximum loads in the plane of its central portion 13A, and thus with the cable B being in this plane when lifting a load. When the load being lifted is not aligned with the plane of the boom 13, the cable B will not be in the plane of the boom 13. As a result, lateral forces are exerted on the end of the boom 13, namely forces that are not in the plane of the boom 13.

As the boom 13 is designed to support loads in its plane, the clutch mechanism 14 allows the boom 13 to adjust its orientation to be aligned with the load (i.e., with the cable B in the plane of the boom 13) in such cases of overload. More specifically, the bolts 44 are tightened so as to have the Belleville washers 45 exert a selected amount of biasing force between the boom flange 36 and the friction ring 43. The biasing force (and gravitational forces), combined with the contact surface between the pinion 46 and the boom flange 36/friction ring 43 (as well as friction coefficients) define the locking force maintaining the pinion 46 locked in position with the boom 13, as engaged with the endless screw 50.

Accordingly, if the lateral forces sustained by the boom 13 exceed the locking force at the clutch 14, the boom 13 will rotate while the endless screw 50 immovably locks the pinion 46, until the lateral forces are reduced or until the cable B is in the plane of the boom 13. Therefore, the clutch 14 ensures the proper orientation of the boom 13 to support a load by allowing overload slipping of the pinion 46.

It is pointed out that the biasing force of the Belleville washers 35 is readily adjusted by tightening/loosening the fasteners 44. For instance, appropriate ratchets are used to perform this adjustment. It is considered to provide different types of Belleville washers as a function of the contemplated use of the boom assembly 10.

The Belleville washers constitute suitable biasing means to provide biasing force to the clutch 14. However, alternative release configurations are considered, such as other types of springs (e.g., helical springs), clutches, a ratchet mechanism or the like.

Once a substantial load is lifted by the boom 13, the load will exert an additional force on the boom flange 36, thereby preventing any slipping of the boom flange 36 with respect to the pinion 46. Accordingly, once a substantial load is lifted by the cable B, orientation adjustments to the boom 13 can only be performed by actuation of the endless screw 50. Therefore, the boom 13 is locked in orientation when a substantial load is lifted, unless actuated by the endless screw 50.

It is considered to provide the boom assembly 10 with its trailer in different segments to fit the boom assembly 10 and the trailer in a box suitable for shipping.

Figure 8:
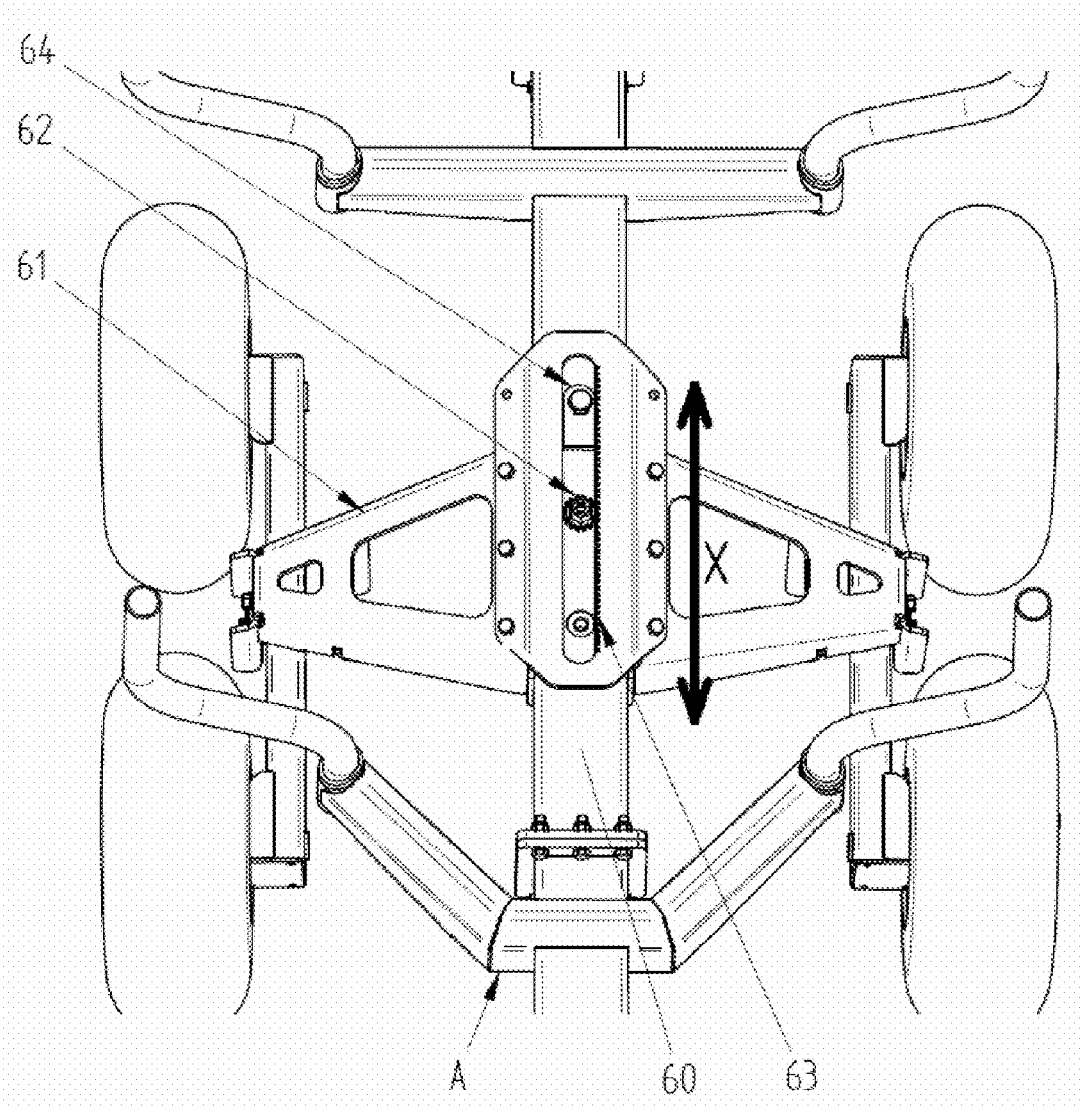
FIG. 8 is a perspective view of the trailer of FIG. 7, in accordance with another embodiment of the present disclosure.

Referring to FIG. 8, a perspective view of the trailer A illustrates a central beam 60 of the trailer A. The central beam

60 supports a tandem axle unit 61 such that the tandem axle unit 61 is translatable along direction X. It is noted that the shape of the tandem axle unit 61 is traingular so as to provide additional clearance between the central beam 60 and the ground.

The trailer A is equipped with a locking mechanism to lock the tandem axle unit 61 in a selected position along the central beam 60. The locking mechanism comprises a spur gear 62 mounted on the central beam 60. The spur gear 62 is free to rotate, but typically requires a tool to be manually rotated.

The spur gear 62 is operatively received in an obround cut-out in the tandem axle unit 61. The cut-out has a pinion wall 63, meshed with the spur gear 62. Accordingly, a rotation of the spur gear 62 results in translational motion of the tandem axle unit 61 along direction X. The position of the unit 61 in the trailer A is therefore adjusted in view of the load that will be received by the trailer A.

In order to lock the unit 61 in a selected position, a locking plate 64 is used. The locking plate 64 has a pinion wall that will mesh with the pinion wall 63. A fastener such as a bolt is received in a tapped hole in the central beam 60 to thereafter lock the translational joint.

Tapped holes are provided on both sides of the spur gear 62, and the appropriate tapped hole is used as a function of the position of the tandem axle unit 61.

The invention claimed is:

1. A boom assembly comprising:

a base anchored to a structure or the ground;

a boom rotatably mounted to the base at a connected end and supported by the base to be in a generally vertical plane so as to be rotatable about a generally vertical axis, the boom having a device to support loads at a free end; and an orientation clutch between the base and the boom, the orientation clutch having a mechanism for locking a rotation of the boom with respect to the generally vertical axis so as to selectively adjust an orientation of the boom, the orientation clutch having a release configuration to allow the rotation of the vertical plane of the boom for the boom to self-adjust its orientation to align the generally vertical plane of the boom with a load pulled by the device.

2. The boom assembly according to claim 1, wherein the orientation clutch has a ring cooperating with the mechanism for locking the rotation of the boom, the ring release configuration comprising biasing members causing frictional forces against the ring, whereby the boom disengages from a locked orientation when lateral loads on the boom are above the frictional forces.

3. The boom assembly according to claim 2, wherein the biasing members are Belleville washers exerting pressure on the ring so as to cause the frictional forces.

4. The boom assembly according to claim 3, wherein the Belleville washers are supported by threaded fasteners, with the threaded fasteners being tightened to increase the pressure exerted by the Belleville washers.

5. The boom assembly according to claim 2, wherein the ring is a pinion threadingly engaged with the mechanism.

6. The boom assembly according to claim 5, wherein the mechanism comprises an endless screw mechanism threadingly engaged with the pinion.

7. The boom assembly according to claim 6, wherein the endless screw mechanism is actuated by a manually-operated crank.

8. The boom assembly according to claim 1, wherein the boom comprises an arcuate beam member.

9. The boom assembly according to claim 8, wherein the arcuate beam member has a T-shaped cross-section.

10. The boom assembly according to claim 8, wherein the boom is pivotable with respect to a generally horizontal axis between a pulling configuration in which the boom is at a horizontal-most position, and a lifting configuration in which the boom is at a vertical-most position.

11. The boom assembly according to claim 10, further comprising biasing means to bias the boom to the vertical-most position.

12. The boom assembly according to claim 1, further comprising a winch on the boom assembly and a pulley system at the free end of the boom, the pulley system comprising an output pulley connected to a barrel, the barrel linking a winch cable from the boom to the output pulley, the barrel being rotatable for the pulley to automatically be oriented toward a load.

13. The boom assembly according to claim 1, wherein the base has a carriage with support legs each having a telescopic mechanism, the support legs being pivotable between a retracted position in which the legs are away from the ground, and a support position in which the legs contact the ground, the carriage having biasing means to lock the support legs in either one of the support position and the retracted position.

14. The boom assembly according to claim 1, wherein the boom assembly is mounted to a trailer.

15. The boom assembly according to claim 14, wherein the trailer comprises a central longitudinal beam upon which a tandem axle unit is'connected so as to be translatable along the central longitudinal beam, and a locking unit to manually adjust a position of the tandem axle unit on the central longitudinal beam, and to lock the translation of the tandem axle unit.

* * * * *